US008742672B2

(12) United States Patent
Chiang et al.

(10) Patent No.: US 8,742,672 B2
(45) Date of Patent: Jun. 3, 2014

(54) LIGHT SOURCE DIMMING CONTROL CIRCUIT

(75) Inventors: Yung-Hsin Chiang, New Taipei (TW); Yi-Mei Li, New Taipei (TW)

(73) Assignee: IML International, Ugland House, Grand Cayman (KY)

( * ) Notice: Subject to any disclaimer, the term of this patent is extended or adjusted under 35 U.S.C. 154(b) by 166 days.

(21) Appl. No.: 13/558,361

(22) Filed: Jul. 26, 2012

(65) Prior Publication Data

US 2014/0028193 A1 Jan. 30, 2014

(51) Int. Cl.
*H05B 37/00* (2006.01)

(52) U.S. Cl.
USPC ..... 315/127; 315/291; 315/294

(58) Field of Classification Search
None
See application file for complete search history.

(56) References Cited

U.S. PATENT DOCUMENTS

| | | | | |
|---|---|---|---|---|
| 5,872,429 | A * | 2/1999 | Xia et al. | 315/194 |
| 6,504,315 | B2 * | 1/2003 | Kim | 315/224 |
| 6,788,005 | B2 * | 9/2004 | Chu et al. | 315/219 |
| 7,088,059 | B2 | 8/2006 | McKinney | |
| 7,265,498 | B2 * | 9/2007 | Liu | 315/224 |
| 7,759,881 | B1 | 7/2010 | Melanson | |
| 7,936,132 | B2 * | 5/2011 | Quek et al. | 315/291 |
| 8,022,634 | B2 * | 9/2011 | Greenfeld | 315/192 |
| 8,143,797 | B2 * | 3/2012 | Yu et al. | 315/224 |
| 8,232,736 | B2 * | 7/2012 | Melanson | 315/247 |
| 8,242,708 | B2 * | 8/2012 | Steiner et al. | 315/295 |
| 8,461,769 | B2 * | 6/2013 | Shiu et al. | 315/291 |
| 2002/0060537 | A1 * | 5/2002 | Lee et al. | 315/DIG. 4 |
| 2005/0253533 | A1 * | 11/2005 | Lys et al. | 315/224 |
| 2009/0079355 | A1 * | 3/2009 | Zhou et al. | 315/246 |
| 2009/0195168 | A1 * | 8/2009 | Greenfeld | 315/192 |
| 2009/0315468 | A1 * | 12/2009 | Wu et al. | 315/186 |
| 2009/0322235 | A1 * | 12/2009 | Shiu et al. | 315/185 R |
| 2009/0322252 | A1 * | 12/2009 | Shiu et al. | 315/297 |
| 2010/0308742 | A1 * | 12/2010 | Melanson | 315/224 |
| 2011/0156607 | A1 * | 6/2011 | Yu et al. | 315/224 |
| 2012/0043902 | A1 * | 2/2012 | Kanamori et al. | 315/223 |
| 2012/0049752 | A1 * | 3/2012 | King et al. | 315/210 |
| 2012/0176055 | A1 * | 7/2012 | Hong et al. | 315/200 R |
| 2012/0187858 | A1 * | 7/2012 | Omi et al. | 315/224 |
| 2014/0042926 | A1 * | 2/2014 | Melanson | 315/247 |

* cited by examiner

*Primary Examiner* — Crystal L Hammond
(74) *Attorney, Agent, or Firm* — Winston Hsu; Scott Margo

(57) ABSTRACT

The present invention provides a light source dimming control circuit, which includes a voltage signal generator for generating a first voltage signal between a predetermined voltage level and a ground level; a reference voltage signal generator for generating a reference voltage signal at an output end according to the first voltage signal and a second voltage signal; a first switch with a first end coupled to an output end of alight source; a first resistor with a first end coupled to a second end of the first switch, and a second end coupled to a ground end; a switch controller coupled to the first switch and the voltage signal generator for controlling on/off states of the first switch according to a sawtooth signal and the first voltage signal; and a current controller for controlling current flowing through the first resistor according to the reference voltage signal.

19 Claims, 5 Drawing Sheets

LIGHT SOURCE DIMMING CONTROL CIRCUIT

BACKGROUND OF THE INVENTION

1. Field of the Invention

The present invention relates to a light source dimming control circuit, and more particularly, to a light source dimming control circuit for dimming a light source between an analog dimming mode and a pulse width modulation dimming mode.

2. Description of the Prior Art

As related technologies improve, various types of light sources, such as light emitting diodes (LEDs) or cold cathode florescent lamps (CCFLs) are applied to various types of illumination devices for purposes of power-saving. The LED light source is a current controlled light source, where brightness of the LED light source is related to a current level of a driving current. Generally, the LED light source can dimmed according to a pulse width modulation method or an analog method.

When in a pulse width modulation dimming mode, a switch is turned on and off interlacedly according to a duty ratio of a pulse width modulation signal, for generating a discrete current as the driving current of the LED light source. Although the pulse width modulation dimming mode can provide better accuracy for controlling the driving current of the LED light source, but the electro-magnetic interference (EMI) also increases as the current level of the driving current getting higher.

When in an analog dimming mode, analog components, such as resistors and capacitors are utilized to generate a continuous current as the driving current of the LED light source. Although the analog dimming mode can reduce the EMI interference, but inaccuracy of the driving current is enlarged by tolerances of the analog components as the current level of the driving current getting lower.

Therefore, it is required to provide a mechanism, which keeps both of the advantages of the analog dimming mode and the pulse width modulation dimming mode, and avoids both of the disadvantages of the analog dimming mode and the pulse width modulation dimming mode.

SUMMARY OF THE INVENTION

The present invention provides a light source dimming control circuit, the light source dimming control circuit comprises a voltage signal generator, a reference voltage signal generator, a first switch, a first resistor, a switch controller, and a current controller. The voltage signal generator is for generating a first voltage signal between a predetermined voltage level and a ground level. The reference voltage signal generator is for generating a reference voltage signal at an output end according to the first voltage signal and a second voltage signal lower than the predetermined voltage level. The reference voltage signal generator comprises a first diode with an anode end coupled to the voltage signal generator, and a cathode end coupled to the output end; and a second diode with an anode end receiving the second voltage signal, and a cathode end coupled to the output end. The first switch has a first end coupled to an output end of a light source. The first resistor has a first end coupled to a second end of the first switch, and a second end coupled to a ground end. The switch controller is coupled to the first switch and the voltage signal generator for turning on the first switch when a sawtooth signal is lower than the first voltage signal, and for turning off the first switch when the sawtooth signal is higher than the first voltage signal. The current controller is coupled to the output end of the reference voltage signal generator and the first end of the first resistor for controlling current flowing through the first resistor according to the reference voltage signal.

The present invention further provides alight source dimming control circuit, the light source dimming control circuit comprises a voltage signal generator, a reference voltage signal generator, a first resistor, a current controller, a first switch, and a switch controller. The voltage signal generator is for generating a first voltage signal between a predetermined voltage level and a ground level. The reference voltage signal generator is for generating a reference voltage signal at an output end according to the first voltage signal and a second voltage signal lower than the predetermined voltage level. The reference voltage signal generator comprises a first diode with an anode end coupled to the voltage signal generator, and a cathode end coupled to the output end; and a second diode with an anode end receiving the second voltage signal, and a cathode end coupled to the output end. The first resistor has a first end coupled to an output end of a light source, and a second end coupled to a ground end. The current controller comprises a transistor coupled between the output end of the light source and the first resistor, and an error amplifier for generating a control voltage at a control end of the transistor according to the reference voltage signal and a voltage level at the first end of the first resistor. The first switch is for turning on the transistor when the first switch is turned off, and for turning off the transistor when the first switch is turned on. The switch controller is coupled to the first switch and the voltage signal generator for turning off the first switch when a sawtooth signal is lower than the first voltage signal, and for turning on the first switch when the sawtooth signal is higher than the first voltage signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
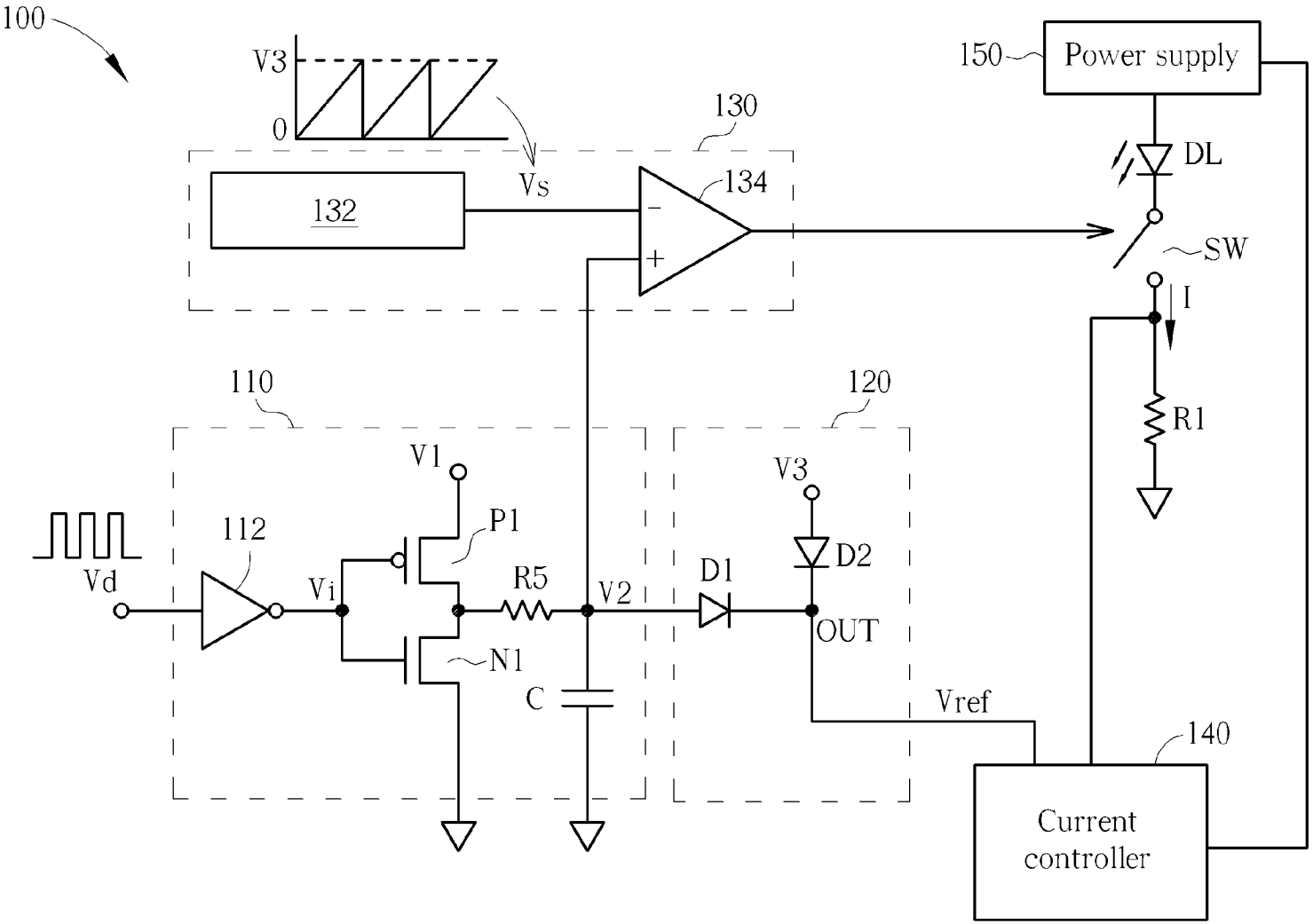
FIG. 1 is a diagram showing a first embodiment of a light source dimming control circuit of the present invention.

Please refer to FIG. 1. FIG. 1 is a diagram showing a first embodiment of a light source dimming control circuit of the present invention. As shown in FIG. 1, the light source dimming control circuit 100 comprises a voltage signal generator 110, a reference voltage signal generator 120, a switch SW, a resistor R1, a switch controller 130, and a current controller 140. The voltage signal generator 110 is utilized for generating a voltage signal V2 between a predetermined voltage level and a ground level. For example, the voltage signal generator 110 comprises an inverter 112, a P-type transistor P1, an N-type transistor N1, a resistor R5, and a capacitor C. The inverter 112 has an input end for receiving a dimming signal Vd, and an output end for outputting an inverse signal Vi opposite to the dimming signal Vd. The dimming signal Vd can be a pulse width modulation signal. The P-type transistor P1 has a source end receiving a voltage signal V1 with the predetermined voltage level, and a gate end coupled to the output end of the inverter 112. The N-type transistor N1 has a drain end coupled to a drain end of the P-type transistor P1, a source end coupled to a ground end, and a gate end coupled to the output end of the inverter 112. The resistor R5 has a first end coupled to the drain end of the P-type transistor P1. The capacitor C has a first end coupled to the second end of the resistor R5, and a second end coupled to the ground end. According to the above arrangement, the inverse signal Vi controls on and off states of the P-type transistor P1 and the N-type transistor N1 interlacedly, such that the voltage signal V2 is generated at the first end of the capacitor C according to a duty ratio of the pulse width modulation signal Vd. A voltage level of the voltage signal V2 varies between a voltage level of the voltage signal V1 and the ground level.

The reference voltage signal generator 120 is utilized for generating a reference voltage signal Vref at an output end OUT according to the voltage signal V2 and a voltage signal V3, which has a voltage level lower than a voltage level of the voltage signal V1. The voltage levels of the voltage signals V1 and V3 are fixed voltage levels. The reference voltage signal generator 120 comprises a first diode D1, and a second diode D2. The first diode D1 has an anode end coupled to the voltage signal generator 110, and a cathode end coupled to the output end OUT. The second diode D2 has an anode end receiving the voltage signal V3, and a cathode end coupled to the output end OUT. According to the above arrangement, when the voltage level of the voltage signal V2 is higher than the voltage level of the voltage signal V3, the reference voltage signal generator outputs the reference voltage signal Vref having a voltage level equal to the voltage level of the voltage signal V2 at the output end OUT; and when the voltage level of the voltage signal V2 is lower than the voltage level of the voltage signal V3, the reference voltage signal generator outputs the reference voltage signal Vref having a voltage level equal to the voltage level of the voltage signal V3 at the output end OUT.

The switch SW has a first end coupled to an output end of a light source DL. The resistor R1 has a first end coupled to a second end of the switch SW, and a second end coupled to the ground end. The switch controller 130 comprises a sawtooth signal generator 132, and a comparator 134. The sawtooth signal generator 132 is utilized for generating a sawtooth signal Vs with a maximum voltage level equal to the voltage level of the voltage signal V3, and a minimum voltage level equal to the ground level. The comparator 134 is coupled to the sawtooth signal generator 132 and the voltage signal generator 110, for comparing the sawtooth signal Vs and the voltage signal V2. The comparator outputs a logic high signal to turn on the switch SW when the sawtooth signal VS is lower than the voltage signal V2, and outputs a logic low signal to turn off the switch SW when the sawtooth signal Vs is higher than the voltage signal V2.

The current controller 140 is coupled to the output end OUT of the reference voltage signal generator 120 and the first end of the resistor R1 for controlling current I flowing through the resistor R1 and light source DL according to the reference voltage signal Vref. For example, the current controller 140 can control a power supply 150 to provide power to the light source DL such that a voltage level at the first end of the resistor R1 is equal to the voltage level of the reference voltage signal Vref, therefore, the current I flowing through the resistor R1 is determined by the voltage level of the reference voltage signal Vref. In addition, there is almost no current flowing into the current controller 140 so the current flowing through the resistor R1 and the current flowing through the light source DL are almost the same.

According to the first embodiment, when the voltage signal V2 is higher than the voltage signal V3, the switch controller 130 continues to turn on the switch SW, and the reference voltage signal Vref varies between the voltage level of the voltage signal V1 and the voltage level of the voltage signal V3, such that the light source DL is dimmed by varying the continuous current I flowing through the resistor R1, which is determined by the voltage level of the reference voltage signal Vref, that is, the light source DL is dimmed in an analog dimming mode; and when the voltage signal V2 is lower than the voltage signal V3, the switch controller 130 interlacedly turns on and turns off the switch SW, and the reference voltage signal Vref is fixed at the voltage level equal to the voltage level of the voltage signal V3, so as to provide the discrete current I with constant current level, such that the light source DL is dimmed by an on-off ratio of the switch SW, that is, the light source DL is dimmed in a pulse width modulation dimming mode.

Therefore, the present invention can set the voltage signal V3 as a threshold voltage between the analog dimming mode and the pulse width modulation dimming mode. The light source dimming control circuit 100 is capable of dimming the light source DL in the analog dimming mode when the current level is high (EMI interference is reduced), and dimming the light source DL in the pulse width modulation dimming mode when the current level is low (accuracy of brightness control is improved).

Figure 2:
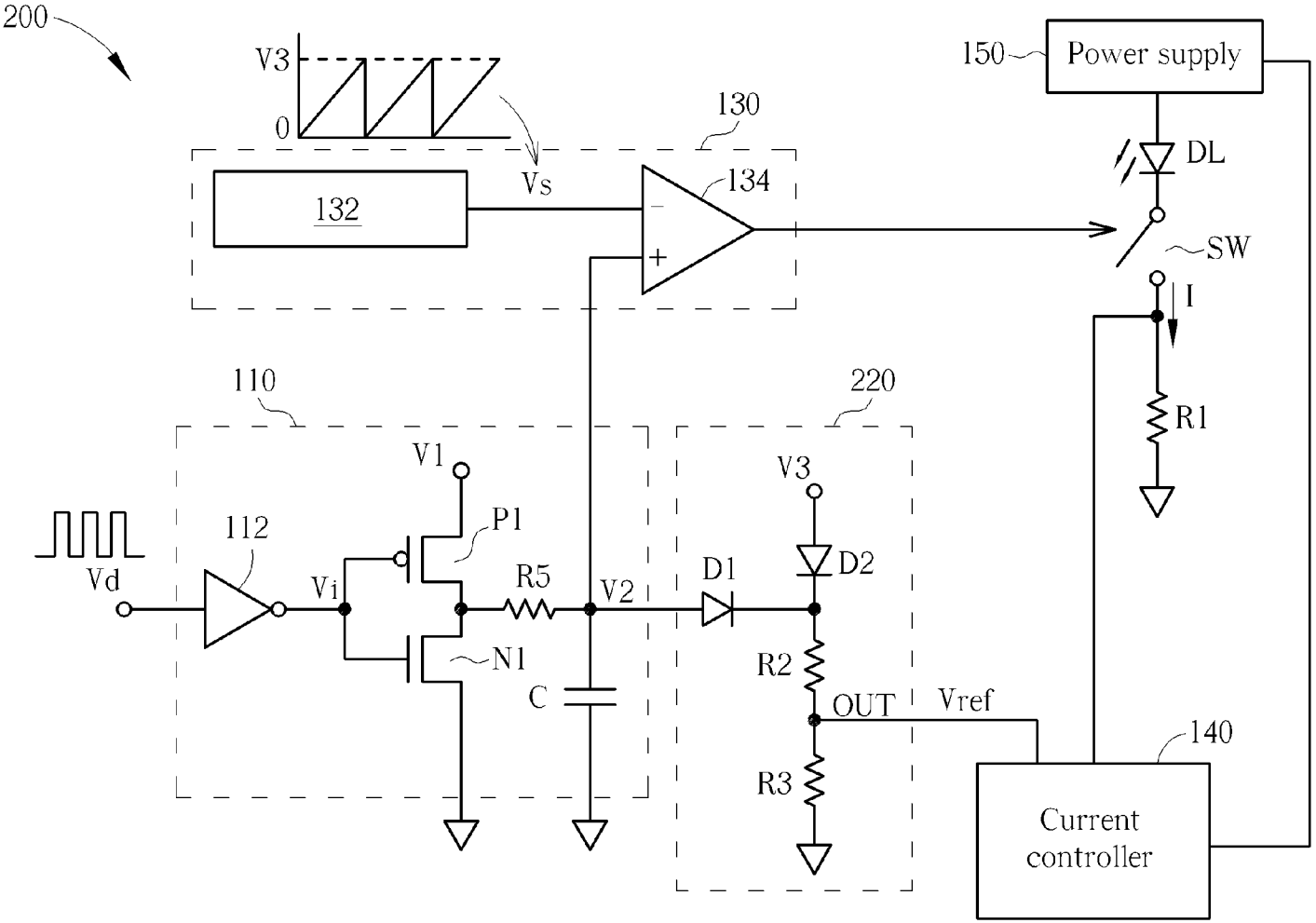
FIG. 2 is a diagram showing a second embodiment of the light source dimming control circuit of the present invention.

Please refer to FIG. 2. FIG. 2 is a diagram showing a second embodiment of the light source dimming control circuit of the present invention. As shown in FIG. 2, the reference voltage signal generator 220 further comprises resistors R2 and R3. The resistor R2 has a first end coupled to the cathode end of the second diode D2, and a second end coupled to the output end OUT. The resistor R3 has a first end coupled to the output end OUT, and a second end coupled to the ground end.

According to the second embodiment, the voltage level of the reference voltage signal Vref can be equal to a certain percentage of the voltage level of the voltage signal V2 or V3, such that power loss on resistor R1 is reduced, and accuracy of the voltage signal V2 is kept.

Figure 3:
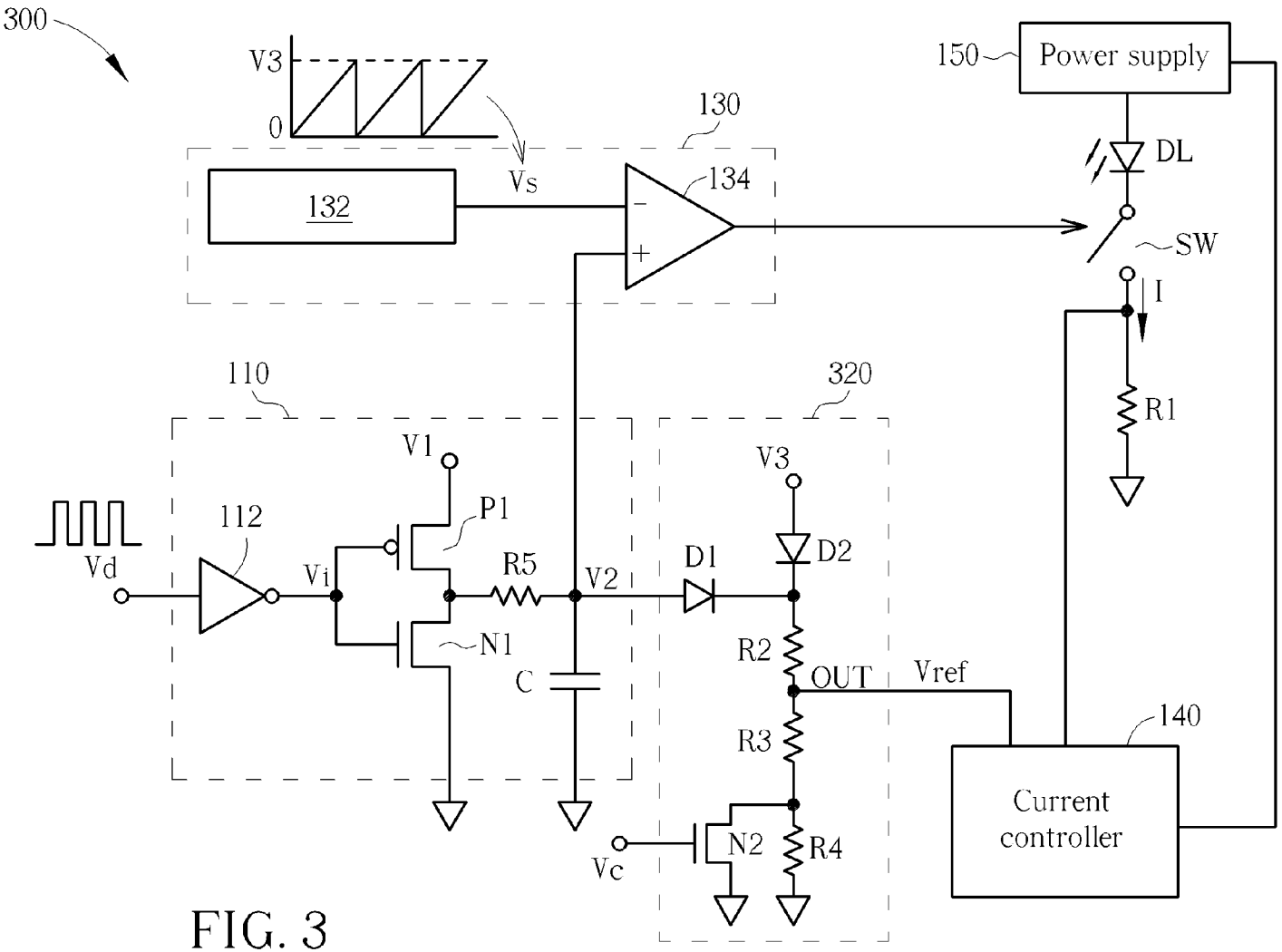
FIG. 3 is a diagram showing a third embodiment of the light source dimming control circuit of the present invention.

Please refer to FIG. 3. FIG. 3 is a diagram showing a third embodiment of the light source dimming control circuit of the present invention. As shown in FIG. 3, the reference voltage signal generator 320 further comprises a resistor R4 and an N-type transistor N2. The resistor R4 has a first end coupled to the second end of the resistor R3, and a second end coupled to the ground end. The N-type transistor N2 has a gate end, a drain end coupled the second end of the resistor R3, and a source end coupled to the ground end. The N-type transistor N2 is utilized for controlling an electrical connection between the second end of the resistor R3 and the ground end according to a control signal Vc received at the gate end of the N-type transistor N2. The N-type transistor N2 can be replaced by any other type of switch.

According to the third embodiment, the light source dimming control circuit 300 can instantly change the voltage level of the reference voltage signal Vref by controlling on and off states of the N-type transistor N2, so as to instantly change brightness of the light source DL both in the analog dimming mode and the pulse width modulation mode.

Figure 4:
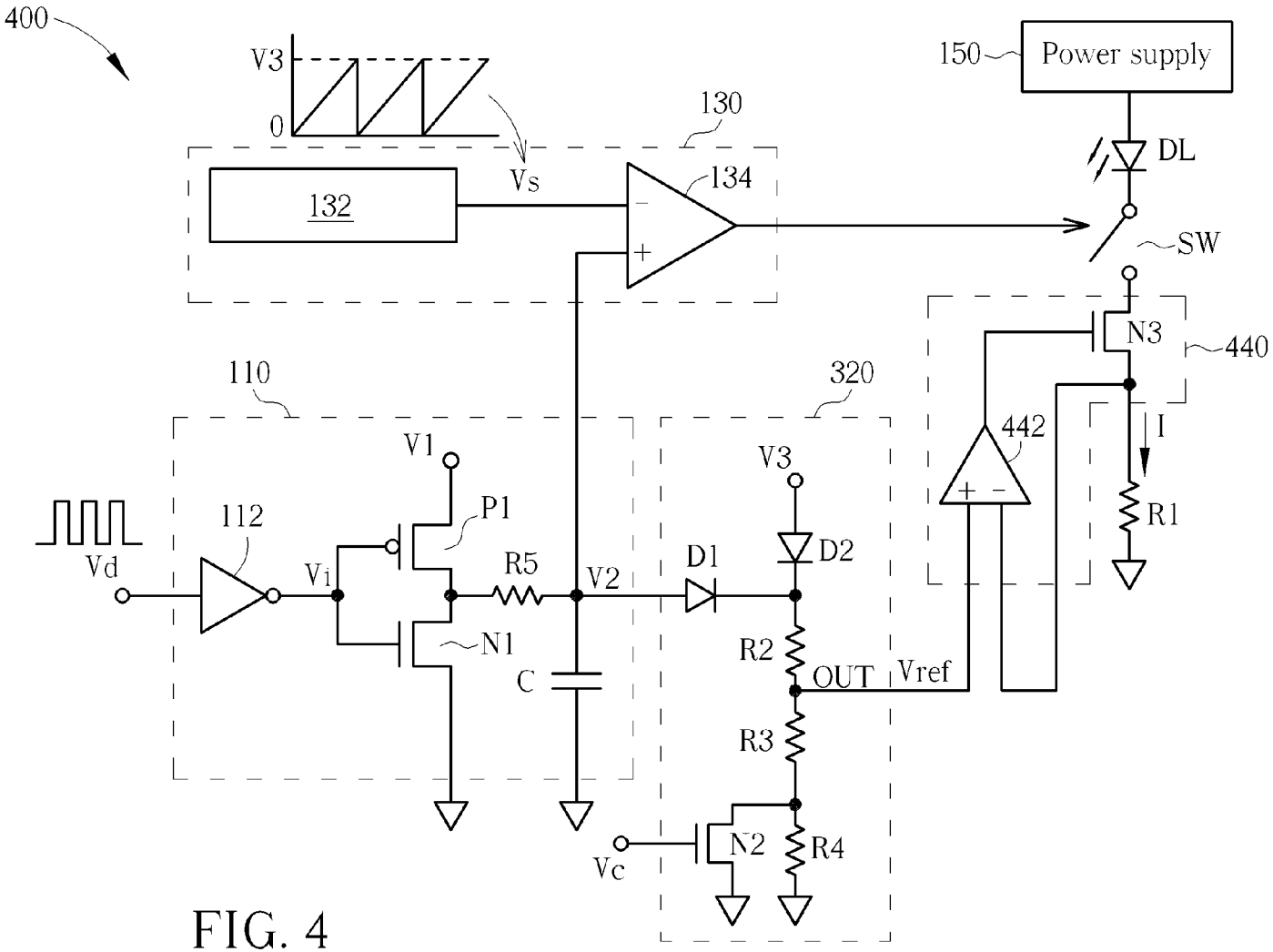
FIG. 4 is a diagram showing a fourth embodiment of the light source dimming control circuit of the present invention.

Please refer to FIG. 4. FIG. 4 is a diagram showing a forth embodiment of the light source dimming control circuit of the present invention. As shown in FIG. 4, the current controller 440 comprises an N-type transistor N3, and an error amplifier 442. The N-type transistor N3 has a drain end coupled to the second end of the switch SW, and a source end coupled to the first end of the resistor R1. The error amplifier 442 is utilized for generating a control voltage at a gate end of the N-type transistor N3 according to the reference voltage signal Vref and the voltage level at the first end of the resistor R1, such that the current I flowing through the resistor R1 is determined by a voltage Vref.

According to the fourth embodiment, the current controller 440 can control the current I by simply adjusting the voltage level Vref.

Figure 5:
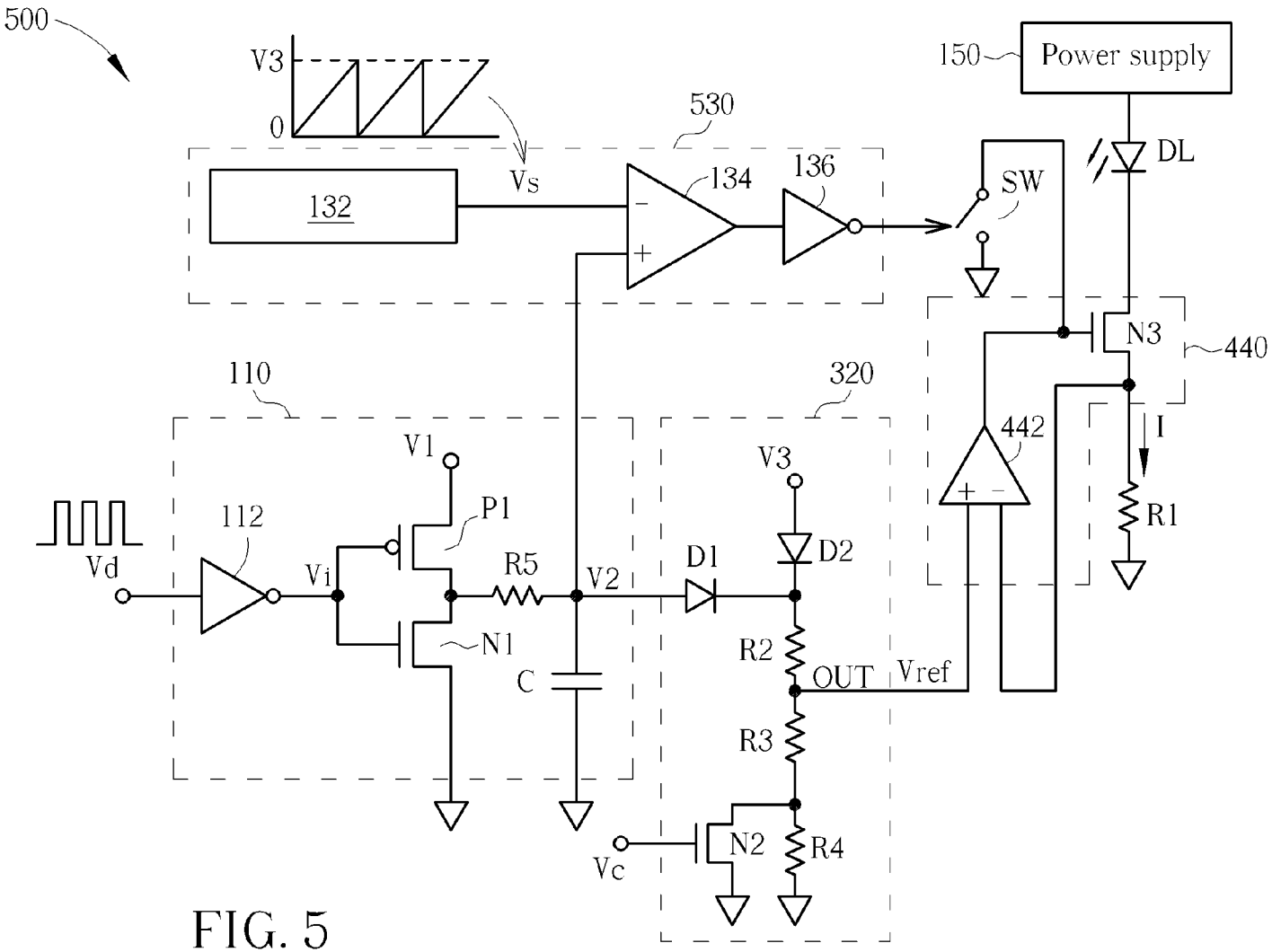
FIG. 5 is a diagram showing a fifth embodiment of the light source dimming control circuit of the present invention.

Please refer to FIG. 5. FIG. 5 is a diagram showing a fifth embodiment of the light source dimming control circuit of the present invention. As shown in FIG. 5, the first end of the switch SW is coupled to the control end of the transistor N3, and the second end of the switch SW is coupled to the ground end. The switch controller 530 further comprises an inverter 136 with an input end for receiving the signals outputted from the comparator 134, and an output end coupled to the switch SW for outputting inverse signals opposite to received signals from the comparator 134. According to the arrangements in FIG. 5, the switch SW is turned on by the inverter 136 when the sawtooth signal is higher than the voltage signal V2, such that the N-type transistor N3 is turned off since the control end of the N-type transistor N3 is coupled to the ground end via the switch SW. The switch SW is turned off by the inverter 136 when the sawtooth signal is lower than the voltage signal V2, such that the N-type transistor N3 is turned on since the control end of the N-type transistor N3 is no longer coupled to the ground end via the switch SW.

In contrast to the prior art, the present invention provides a light source dimming control circuit capable of dimming the light source in the analog dimming mode when the current level is high, and dimming the LED light source in the pulse width modulation dimming mode when the current level is low. Therefore, both of the advantages of the analog dimming mode and the pulse width modulation dimming mode can be kept, and both of the disadvantages of the analog dimming mode and the pulse width modulation dimming mode can be avoided.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light source dimming control circuit, comprising:
- a voltage signal generator for generating a first voltage signal between a predetermined voltage level and a ground level;
- a reference voltage signal generator for generating a reference voltage signal at an output end according to the first voltage signal and a second voltage signal lower than the predetermined voltage level, the reference voltage signal generator comprising:
  - a first diode with an anode end coupled to the voltage signal generator, and a cathode end coupled to the output end; and
  - a second diode with an anode end receiving the second voltage signal, and a cathode end coupled to the output end;
- a first switch with a first end coupled to an output end of a light source;
- a first resistor with a first end coupled to a second end of the first switch, and a second end coupled to a ground end;
- a switch controller coupled to the first switch and the voltage signal generator for turning on the first switch when a sawtooth signal is lower than the first voltage signal, and for turning off the first switch when the sawtooth signal is higher than the first voltage signal; and
- a current controller coupled to the output end of the reference voltage signal generator and the first end of the first resistor for controlling current flowing through the first resistor according to the reference voltage signal.

2. The light source dimming control circuit of claim 1, wherein the current controller controls a power supply to provide power to the light source such that a voltage level at the first end of the first resistor is equal to a voltage level of the reference voltage signal.

3. The light source dimming control circuit of claim 1, wherein the current controller comprises:
- an N-type transistor with a first end coupled to the second end of the first switch, and a second end coupled to the first end of the first resistor; and
- an error amplifier for generating a control voltage at a control end of the N-type transistor according to the reference voltage signal and a voltage level at the first end of the first resistor.

4. The light source dimming control circuit of claim 1, wherein the switch controller comprises:
- a sawtooth signal generator for generating the sawtooth signal; and
- a comparator coupled to the sawtooth signal generator and the voltage signal generator, for outputting a logic high signal to the first switch to turn on the first switch when the sawtooth signal is lower than the first voltage signal, and for outputting a logic low signal to the first switch to turn off the first switch when the sawtooth signal is higher than the first voltage signal.

5. The light source dimming control circuit of claim 1, wherein the voltage signal generator comprises:
- an inverter with an input end for receiving a dimming signal, and an output end for outputting an inverse signal opposite to the dimming signal;
- a P-type transistor with a first end receiving a third voltage signal with the predetermined voltage level, and a control end coupled to the output end of the inverter;
- an N-type transistor with a first end coupled to a second end of the P-type transistor, a second end coupled to the ground end, and a control end coupled to the output end of the inverter;
- a second resistor with a first end coupled to the second end of the P-type transistor, and a second end coupled to the anode end of the first diode; and
- a capacitor with a first end coupled to the anode end of the first diode, and a second end coupled to the ground end.

6. The light source dimming control circuit of claim 5, wherein the dimming signal is a pulse width modulation signal.

7. The light source dimming control circuit of claim 1, wherein the reference voltage signal generator further comprises:
- a second resistor with a first end coupled to the cathode end of the second diode, and a second end coupled to the output end; and
- a third resistor with a first end coupled to the output end, and a second end coupled to the ground end.

8. The light source dimming control circuit of claim 1, wherein the reference voltage signal generator further comprises:

a second resistor with a first end coupled to the cathode end of the second diode, and a second end coupled to the output end;

a third resistor with a first end coupled to the output end;

a fourth resistor with a first end coupled to a second end of the third resistor, and a second end coupled to the ground end; and a second switch with a first end coupled to the second end of the third resistor, and a second end coupled to the ground end, for controlling an electrical connection between the second end of the third resistor and the ground end according to a control signal.

9. The light source dimming control circuit of claim 8, wherein the second switch is an N-type transistor.

10. The light source dimming control circuit of claim 1, wherein a maximum voltage level of the sawtooth signal is equal to a voltage level of the second voltage signal, and a minimum voltage level of the sawtooth signal is equal to the ground level.

11. A light source dimming control circuit, comprising:

a voltage signal generator for generating a first voltage signal between a predetermined voltage level and a ground level;

a reference voltage signal generator for generating a reference voltage signal at an output end according to the first voltage signal and a second voltage signal lower than the predetermined voltage level, the reference voltage signal generator comprising:

a first diode with an anode end coupled to the voltage signal generator, and a cathode end coupled to the output end; and a second diode with an anode end receiving the second voltage signal, and a cathode end coupled to the output end;

a first resistor with a first end coupled to an output end of a light source, and a second end coupled to a ground end;

a current controller comprising:

a transistor coupled between the output end of the light source and the first resistor; and an error amplifier for generating a control voltage at a control end of the transistor according to the reference voltage signal and a voltage level at the first end of the first resistor;

a first switch for turning on the transistor when the first switch is turned off, and for turning off the transistor when the first switch is turned on; and a switch controller coupled to the first switch and the voltage signal generator for turning off the first switch when a sawtooth signal is lower than the first voltage signal, and for turning on the first switch when the sawtooth signal is higher than the first voltage signal.

12. The light source dimming control circuit of claim 11, wherein a first end of the first switch is coupled to the control end of the transistor, and a second end of the first switch is coupled to the ground end.

13. The light source dimming control circuit of claim 11, wherein the switch controller comprises:

a sawtooth signal generator for generating the sawtooth signal;

a comparator coupled to the sawtooth signal generator and the voltage signal generator, for outputting a logic high signal when the sawtooth signal is lower than the first voltage signal, and for outputting a logic low signal when the sawtooth signal is higher than the first voltage signal; and an inverter with an input end for receiving the signals outputted from the comparator, and an output end coupled to the first switch for outputting inverse signals opposite to received signals from the comparator.

14. The light source dimming control circuit of claim 11, wherein the voltage signal generator comprises:

an inverter with an input end for receiving a dimming signal, and an output end for outputting an inverse signal opposite to the dimming signal;

a P-type transistor with a first end receiving a third voltage signal with the predetermined voltage level, and a control end coupled to the output end of the inverter;

an N-type transistor with a first end coupled to a second end of the P-type transistor, a second end coupled to the ground end, and a control end coupled to the output end of the inverter;

a second resistor with a first end coupled to the second end of the P-type transistor, and a second end coupled to the anode end of the first diode; and a capacitor with a first end coupled to the anode end of the first diode, and a second end coupled to the ground end.

15. The light source dimming control circuit of claim 14, wherein the dimming signal is a pulse width modulation signal.

16. The light source dimming control circuit of claim 11, wherein the reference voltage signal generator further comprises:

a second resistor with a first end coupled to the cathode end of the second diode, and a second end coupled to the output end; and a third resistor with a first end coupled to the output end, and a second end coupled to the ground end.

17. The light source dimming control circuit of claim 11, wherein the reference voltage signal generator further comprises:

a second resistor with a first end coupled to the cathode end of the second diode, and a second end coupled to the output end;

a third resistor with a first end coupled to the output end;

a fourth resistor with a first end coupled to a second end of the third resistor, and a second end coupled to the ground end; and a second switch with a first end coupled to the second end of the third resistor, and a second end coupled to the ground end, for controlling an electrical connection between the second end of the third resistor and the ground end according to a control signal.

18. The light source dimming control circuit of claim 17, wherein the second switch is an N-type transistor.

19. The light source dimming control circuit of claim 11, wherein a maximum voltage level of the sawtooth signal is equal to a voltage level of the second voltage signal, and a minimum voltage level of the sawtooth signal is equal to the ground level.

* * * * *